United States Patent [19]

Klimazewski et al.

[11] 4,178,755

[45] Dec. 18, 1979

[54] FORCED AIR CONTROL VALVE FOR EXHAUST SYSTEM OF INTERNAL COMBUSTION ENGINE

[75] Inventors: Leo T. Klimazewski; James A. McNairy, both of St. Louis, Mo.

[73] Assignee: ACF Industries, Incorporated, New York, N.Y.

[21] Appl. No.: 864,138

[22] Filed: Dec. 23, 1977

[51] Int. Cl.[2] ..... F01N 3/10

[52] U.S. Cl. ..... 60/290; 60/284; 60/306

[58] Field of Search ..... 60/290, 306, 284

[56] References Cited

U.S. PATENT DOCUMENTS

| | | | |
|---|---|---|---|
| 3,849,984 | 11/1974 | Toda | 60/290 |
| 3,869,858 | 3/1975 | Goto | 60/290 |
| 3,888,080 | 6/1975 | Nohira | 60/290 |
| 3,992,878 | 11/1976 | Moorman | 60/290 |
| 4,050,249 | 9/1977 | Collins | 60/290 |
| 4,070,830 | 1/1978 | Beiswenger | 60/290 |

*Primary Examiner*—Douglas Hart

*Attorney, Agent, or Firm*—Edward H. Casey; J. Joseph Muller

[57] ABSTRACT

A forced air control valve for an air injection system in an internal combustion engine is shifted during cold engine operation to divert air flow to the exhaust manifold upstream of a catalytic converter bed to supply air to the exhaust gases for further combustion prior to entry in the catalytic converter. A diaphragm operated main valve is responsive to a vacuum from the intake manifold for diverting air to the exhaust manifold and a temperature activated vacuum switch shuts off the vacuum when the engine warms up. Upon deceleration during cold engine operation the control valve is shifted to divert air away from the exhaust manifold.

2 Claims, 9 Drawing Figures

FIG. 2
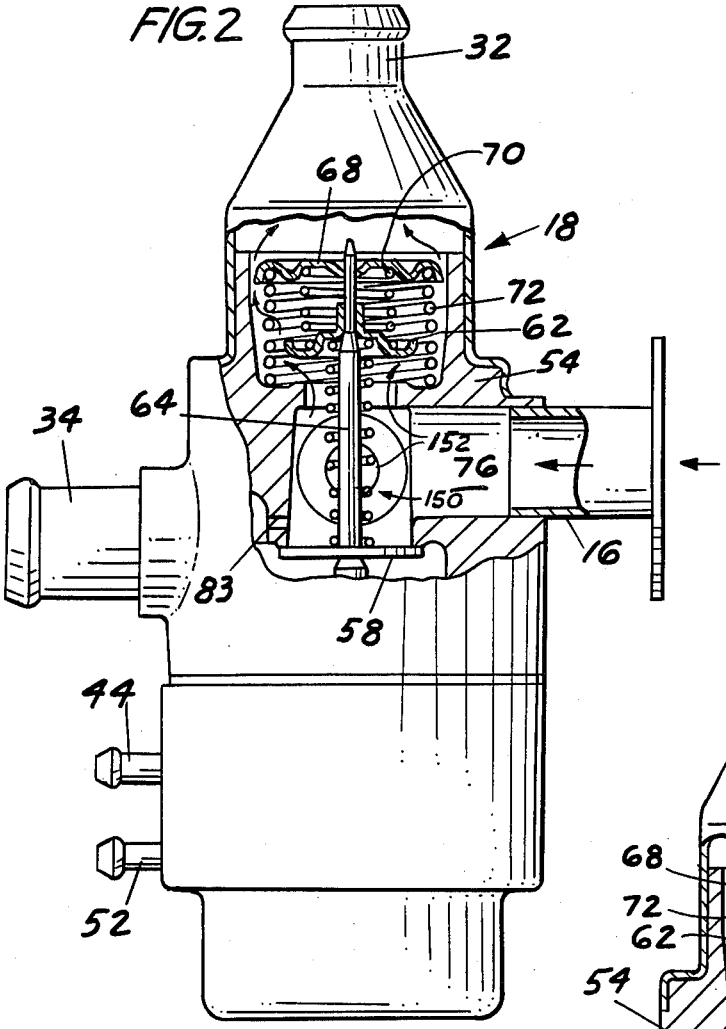
FIG. 3
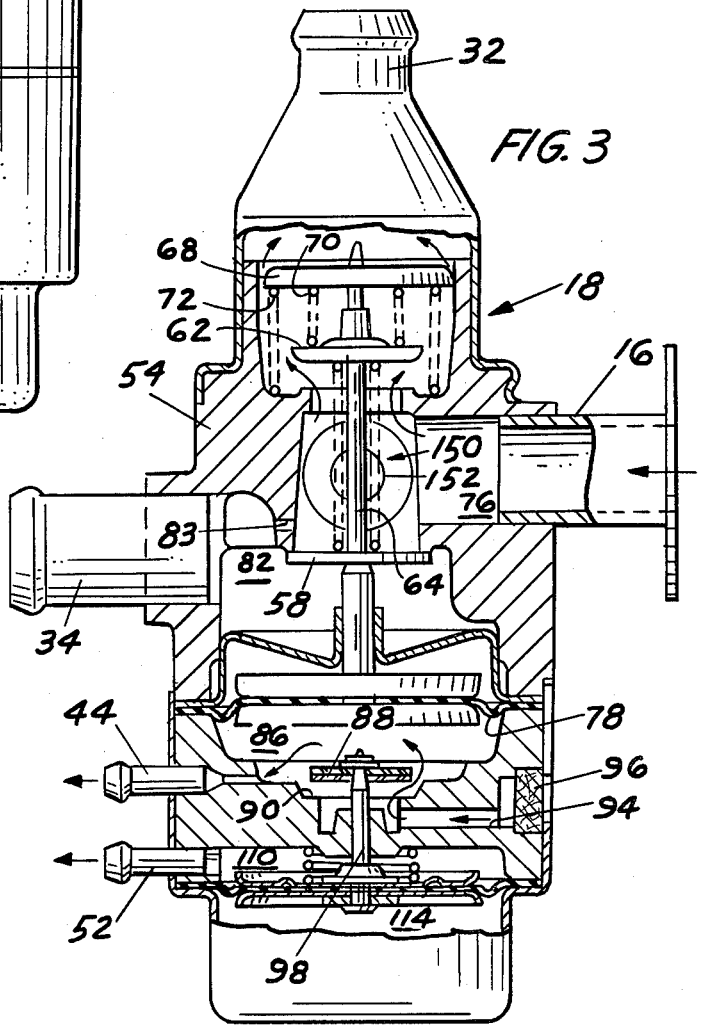
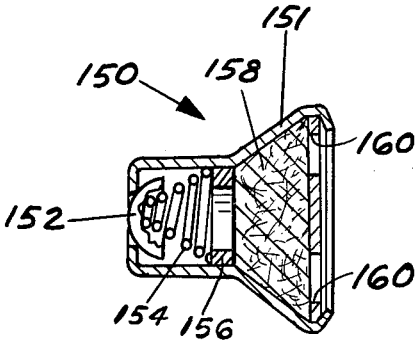
FIG. 4

FORCED AIR CONTROL VALVE FOR EXHAUST SYSTEM OF INTERNAL COMBUSTION ENGINE

BACKGROUND OF THE INVENTION

This invention relates to a forced air control valve for use in an air system which delivers air from an air pump to the exhaust manifold of an internal combustion engine and which may be shifted to divert air from the exhaust manifold. Reference is made to copending application Ser. No. 622,943 filed Oct. 16, 1975 entitled "Forced Air Control Valve for Exhaust Pipe of Internal Combustion Engine", now abandoned, in which a forced air control valve is provided to control the flow of air into the exhaust pipe of an internal combustion engine immediately upstream of the oxidizing catalytic converter and may be shifted to divert air to the atmosphere. A vacuum line which controls the shifting of the valve is connected to the intake manifold of the engine and upon a rapid deceleration, a high vacuum is exerted from the intake manifold to effect shifting of the valve for venting the air flow from the air pump to atmosphere. An auxiliary diaphragm assembly shown in aforementioned copending application Ser. No. 622,943 controls a venting of the main vacuum chamber to astmosphere after deceleration.

The air pump is belt driven from the crankshaft of the engine and forces air into the exhaust manifold of the engine to mix with incompletely burned gases from the exhaust while the gases are still hot enough to support combustion. An additional burning takes place in the exhaust system so that the quantity of unburned hydrocarbons and carbon monoxide is greatly reduced. The additional burning of gases in the exhaust manifold creates additional heat and during deceleration of the engine, it is desirable to interrupt the flow of air to the exhaust manifold in order to prevent audible backfires.

A catalytic converter bed normally comprises a primary reducing catalytic converter and a secondary oxidizing catalytic converter in the exhaust pipe, and it is desirable to provide air upstream of the converters to permit maximum burning of the unburned hydrocarbons and carbon monoxide in the exhaust gases.

Prior U.S. Pat. No. 3,924,408 dated Dec. 9, 1975 shows a diverter valve and pressure regulator assembly in which an air control valve diverts the entire air flow away from the exhaust system to prevent exhaust backfiring. The control valve also has a pressure relief valve member which permits a portion of the air flow to escape when the air pump pressure exceeds a certain value to minimize the possibility of an over supply of air being supplied to the exhaust system to provide a condition where a backfire may occur. The diverter valve shown in U.S. Pat. No. 3,924,408 is controlled primarily by a vacuum line from the intake manifold of the engine. Upon engine deceleration the intake manifold vacumm rises abruptly and an auxiliary vent valve is opened upon the abrupt change in the manifold vacuum to equalize pressures across the actuating diaphragm.

BRIEF DESCRIPTION OF THE INVENTION

The control valve of the present invention is a diverter or switching valve particularly responsive to a cold engine condition and permitting air flow to the manifold exhaust during cold engine operation while interrupting air flow to the manifold exhaust after warmup of the engine. The diverter or switching valve is responsive to deceleration at both hot and cold engine conditions as abrupt change in vacuum is provided upon deceleration which creates a differential across the auxiliary diaphragm to vent the main vacuum chamber to atmosphere for a predetermined controlled amount of time.

During cold engine operation a relatively rich mixture is provided and it is desirable to provide air to the exhaust manifold during cold engine operation to increase the combustion of the unburned hydrocarbons and carbon monoxide before the exhaust gases reach the catalytic converters. It is desirable to force air into the exhaust manifold of the engine as near the exhaust valves of the engine as possible so that the combustion of the exhaust gases takes place while they are still hot enough to support combustion and thus effect warmup of the catalytic converters during cold engine operation.

The present invention provides an air control valve for use on an internal combustion engine having an exhaust system with a catalytic converter therein and an air pump for supplying air to the exhaust system. The air control valve has a main valve shiftable between open and closed positions and supplying air to the exhaust manifold when in an open position. The main valve is diaphragm actuated and a separate vacuum line to the main vacuum chamber effects movement of the diaphragm to an open position of the valve when a vacuum is exerted to the main vacuum chamber for providing air to the exhaust manifold. The vacuum for the main vacuum chamber is controlled by a temperature activated vacuum switch which interrupts or closes the vacuum line when the engine temperature reaches a warm operating condition. Thus, the main valve is opened only during cold engine operation.

However, upon rapid deceleration during cold engine operation, a separate diaphragm actuated auxiliary vent valve is actuated to vent the main diaphragm chamber to atmosphere for a limited period of time to close the main valve which is desirable upon rapid deceleration. An air bleed passage is provided in the auxiliary diaphragm to permit the auxiliary vent valve to return to a closed position and the size of the air bleed passage is calibrated for a predetermined delay in the reclosing of the auxiliary vent valve thereby delaying the return of the main valve to an open position. By delaying the return of the main valve to an open position during cold engine operation, adequate time is provided to permit the pollutants in the exhaust system to be exhausted before additional air is supplied to the exhaust manifold.

A pressure relief is provided so that air supplied by the air pump either to the exhaust manifold or to the exhaust pipe may be relieved in the event it reaches a predetermined high pressure. It is desirable to keep the supply of air below a certain pressure in order to eliminate backfires which might occur upon an over supply of air being furnished under certain conditions of engine operation.

BRIEF DESCRIPTION OF THE DRAWINGS

The foregoing and other objects, features and advantages of the invention will be apparent from the following more particular description of the preferred embodiments of the invention, as illustrated in the accompanying drawings in which reference characters refer to the same parts throughout the different views.

FIG. 2 is an elevational view with certain parts broken away to show the control valve of FIG. 1 with the main valve member closed and air being supplied from the air pump to the exhaust pipe upstream of an oxidizing catalytic converter bed and downstream of a reducing catalytic converter bed;

FIG. 3 is a sectional view similar to FIG. 1 but showing the vent valve in an open position to vent the main vacuum chamber to atmosphere which occurs during a rapid deceleration;

FIG. 4 is a sectional view of the relief valve shown removed from the control valve.

Referring now to FIG. 1, an internal combustion engine 10 drives an air pump 12 which supplies air through conduit 14 to the inlet 16 of an air control valve forming this invention and indicated generally at 18. An exhaust manifold is indicated at 20 and an exhaust pipe 22 extends from exhaust manifold 20. Mounted in exhaust pipe 22 is a first reducing catalytic converter bed 24 and a second oxidizing catalytic converter 26. The reducing catalytic converter bed 24 is intended to break down nitrogen-oxygen compounds into nitrogen gas and oxygen gas. The second oxidizing converter bed 26 is intended to convert hydrocarbons and carbon monoxide into carbon dioxide and a water vapor. Oxidizing catalytic converter bed 26 requires additional oxygen in order to function properly. Air control valve 18 shifts between two positions, one position in which air is supplied through conduit 28 to exhaust pipe 22 upstream of oxidizing catalytic converter bed 26 and a second position in which air is supplied through conduit 30 to manifold exhaust 20 at a position adjacent the exhaust valves of the engine at which location the exhaust valves are still hot enough to support combustion and additional burning takes place before the exhaust gases reach the exhaust pipe and the converter beds 24 and 26. Conduit 28 extends from nipple 32 of control valve 18 and conduit 30 extends from nipple 34 of control valve 18.

Figure 1:
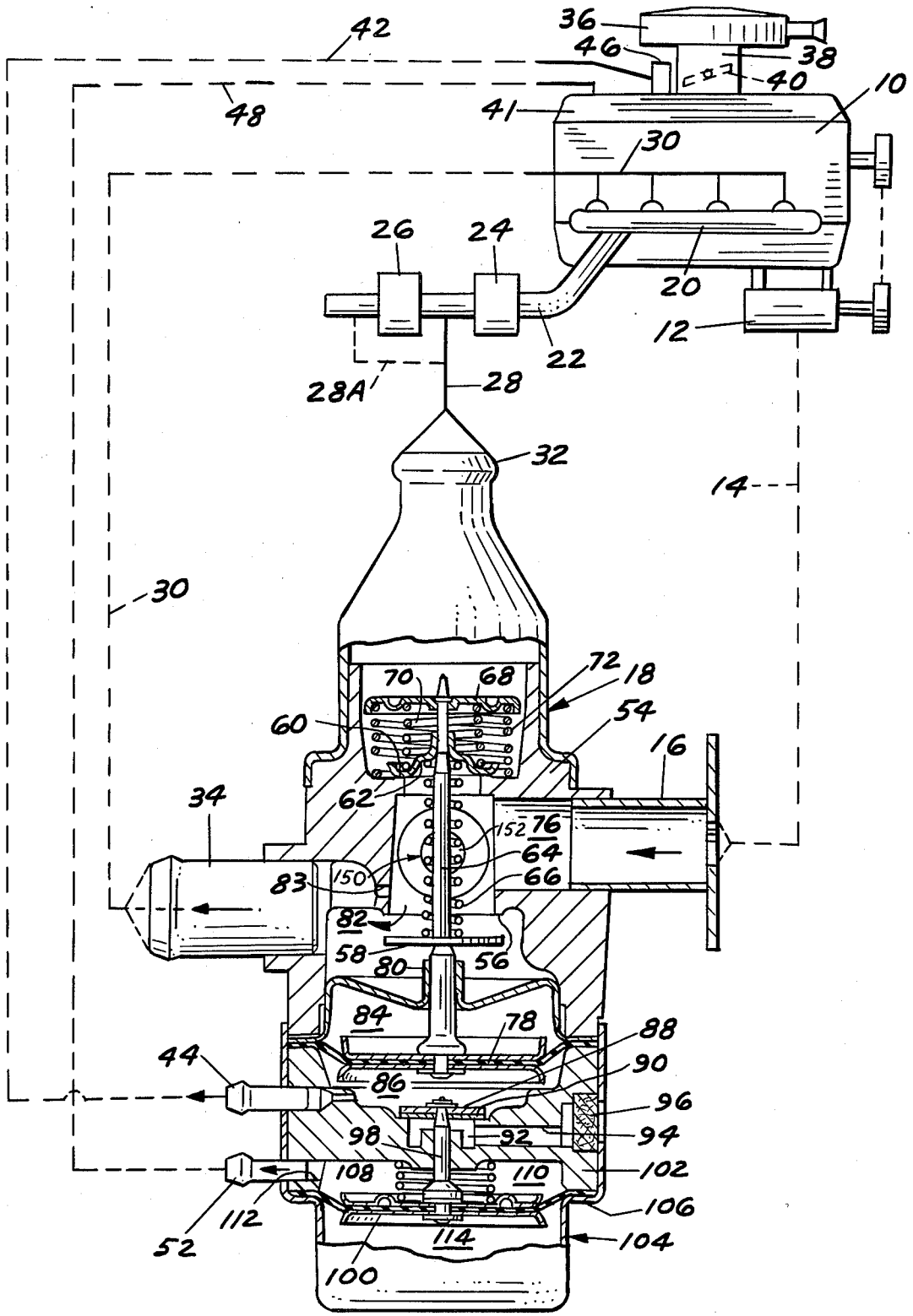
FIG. 1 is a partially schematic view of an internal combustion engine having an air pump for delivering air to the exhaust system and showing the air control valve of the present invention in an enlarged sectional view with the control valve in an open position and supplying air from the air pump to the exhaust manifold.

An air cleaner 36 is mounted on the upper end of a carburetor 38 having a throttle valve 40 therein and mounted over intake manifold 41 of internal combustion engine 10. A vacuum line 42 from the intake manifold 41 adjacent the idle enrichment extends to a vacuum nipple 44 of control valve 18. Vacuum line 42 is controlled by a temperature activated ported vacuum switch indicated schematically at 46 and provided in the water jacket of internal combustion engine 10. The ported vacuum switch is open during cold engine operation to permit a vacuum through line 42 to nipple 44 but when the engine is warm, switch 46 blocks or interrupts the vacuum exerted through line 42 to nipple 44. A separate vacuum line 48 extends from intake manifold 41 to intake manifold nipple 52 on air control valve 18. The vacuum from intake manifold 41 is in continuous communication with nipple 52.

Control valve 18 has a main body 54 with inlet nipple 16 and outlet nipple 34 thereon. A generally frusto-conical nipple 32 is fitted around body 54 on one end thereof. Body 54 has a main valve seat 56 on which main valve 58 is adapted to seat. A secondary valve seat 60 has a secondary valve member 62 for seating thereon. A valve stem 64 has main valve member 58 and secondary valve member 62 mounted theron. A spring 66 extends between valve member 62 and valve member 58. Mounted on one end of stem 64 is a spring retainer member 68 having an inner spring 70 seated thereon between retainer member 68 and valve member 62 to urge valve member 62 downwardly into engagement with seat 60. An outer coil spring 72 is seated between retainer 68 and valve body 54 to urge continuously stem 64 toward the seated position of main valve member 58 as shown in FIGS. 2 and 3. Valve member 62 is mounted for sliding movement along a reduced end portion of valve stem 64 and when air pressure within main valve chamber 76 reaches a sufficiently high magnitude, member 62 will temporarily unseat against the bias of spring 70 and thereby permit a flow of air through outlet 32 and conduit 28 to exhaust pipe 22. The end of stem 64 is secured to a diaphragm 78 which is connected about an outer peripheral portion to main body 54 of air valve 18. A guide 80 is mounted within a central air chamber 82 and stem 64 is adapted to move axially relative to guide 80. An air tight seal is not provided between central air chamber 82 and a secondary air chamber 84 and a small leakage of air occurs between chamber 82 and chamber 84 about guide 80 to equalize the air pressure therebetween. A relatively small port 83 extends between valve chamber 76 and nipple 34 through a portion of body 54 to provide a small amount of air flow from air pump 12 to exhaust manifold 20 at all times during operation of air pump 12, even when main valve member 58 is closed.

A main vacuum chamber 86 is disposed on the side of diaphragm 78 opposite chamber 84 and a vacuum is exerted from nipple 44 through vacuum line 42 only during cold engine operation as the temperature responsive vacuum switch 46 for line 42 interrupts the vacuum after warmup of engine 10.

A vent valve 88 is seated on seat 90 about an opening 92 which communicates with bore 94 leading to atmosphere through a filter 96. A stem 98 secured to vent valve 88 adjacent one end is mounted adjacent its other end to an auxiliary diaphragm assembly 99 including a diaphragm 100 which is gripped about its peripheral edge portion between a lower body portion 102 and an outer enclosed generally cylindrical housing 104. A peripheral flange 106 about housing 104 engages diaphragm 100 in a gripping relation. A spring 108 urges diaphragm 100 downwardly to the seated position of vent valve 88 on seat 90. An auxiliary vacuum chamber 110 for diaphragm 100 is connected by a passage 112 to nipple 52 leading to intake manifold 44 through conduit 48. Housing 104 forms a closed air chamber 114 on the side of diaphragm 100 opposite chamber 110.

Referring particularly to FIGS. 5–9, details of the construction of the auxiliary diaphragm are illustrated. Head 116 is on a reduced diameter portion 118 of stem 98 and a pair of spaced washers 120 and 122 retain upper support plate 124 and lower support plate 126 on opposite sides of diaphragm 100. Plates 124 and 126 are held in clamping relation with diaphragm 100. Upper plate 124 has a pair of apertures 128 on opposite sides of the stem opening and a bleed hole 130 is also provided. An arcuate boss 132 is embossed on the surface of plate 124. Lower diaphragm plate 126 has a plurality of apertures 134. Diaphragm 100 has two arcuate cutaway portions 138 and 140 which do not intersect and form flaps 142 and 144 which act as valves during operation of the assembled unit.

Referring to FIG. 4, a pressure relief valve is generally indicated at 150 for chamber 76 and includes an outer housing 151 with a ball member 152 urged toward a seated position by coil spring 154 secured to a spring seat 156. A filter 158 filters the air before it is discharged through vents 160 to atmosphere. Thus, whenever the pressure in chamber 76 reaches a predetermined high, ball member 152 will unseat and discharge air to atmosphere until the predetermined temperature is again reached at which time ball member 152 will reseat to block the flow of air from the vent.

Figure 5:
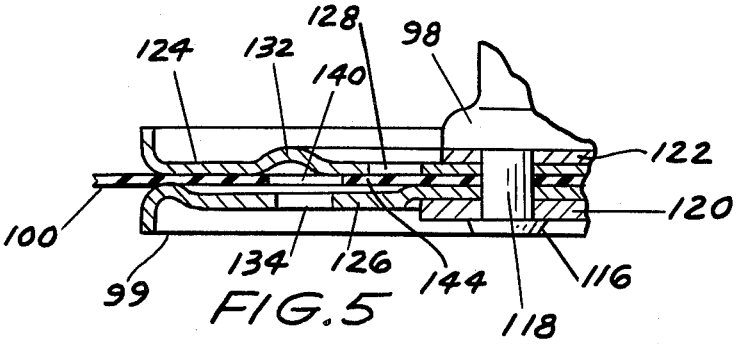
FIGS. 5–9 show enlarged details of the auxiliary diaphragm assembly to control the closing of the vent valve after opening.

When the pressures in closed air chamber 114 and in the auxiliary vacuum chamber 110 are the same, diaphragm 100 has no effect on the operation of the valve. Upon a rapid deceleration, however, the vacuum in conduit 48 applied against chamber 110 increases substantially and a pressure differential exists between closed air chamber 114 and vacuum chamber 110 to move diaphragm 100 upwardly for unseating of vent valve 88 and venting of chamber 86 to atmosphere through passage 94. Flaps 142 and 144 seal off openings 128 as shown in FIG. 5. The speed at which vent valve 88 reseats is controlled by the size of bleed hole or opening 130 which provides a delay in the reseating of vent valve 88. Under cold engine operation with main valve 58 open, the venting of main vaccum chamber 86 to atmosphere results in the immediate closing of valve 58 as atmospheric pressure is exerted against diaphragm 78 therety interrupting the supply of air to exhaust manifold 20. Valve 58 remains closed during cold engine operation until vent valve 88 reseats at which time valve 58 will open. During warm engine operation, vent valve 88 has no effect on main valve 58. The time delay for the reseating of vent valve 88 is determined by the time required for the equalization of pressures in closed air chamber 114 and diaphragm chamber 110 and assuming an initial differential pressure of around five (5) to seven (7) inches of mercury, bleed opening 130 is calibrated to an equalization of pressures within a period of around two (2) to five (5) seconds.

Figure 6:
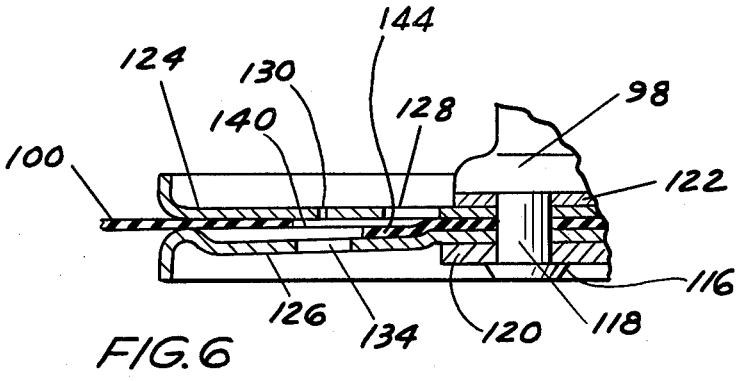
Figure 7:
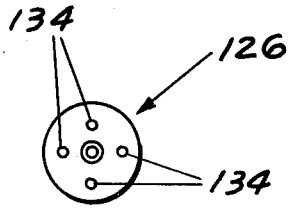
Figure 8:
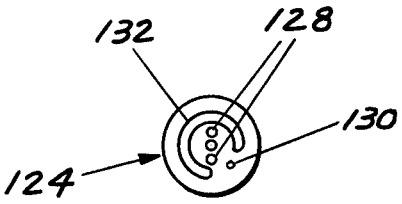
Figure 9:
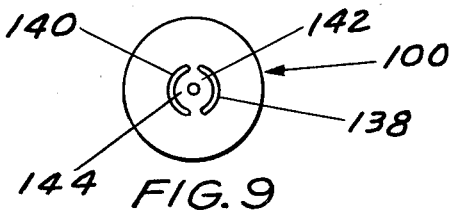

Flaps 142 and 144 permit vent valve 88 to return rapidly upon a sudden acceleration which will increase the pressure in the intake manifold and reverse the pressure differential across diaphragm 100. The reversed pressure will move flaps 142 and 144 downwardly as shown in FIG. 6 to allow air to move rapidly by ports 128 and 134 to equalize the pressure between closed air chamber 114 and diaphragm chamber 110.

In operation, during engine operation pump 12 continuously supplies air through conduit 14 to inlet 16 to control valve 18 where it enters chamber 76. During cold engine operation, vacuum line 42 is open and a vacuum from the intake manifold is exerted through nipple 44 to main vacuum chamber 86 thereby resulting in the opening of main valve 58 as shown in FIG. 1 for the supply of air to exhaust manifold 20. During cold engine operation, a rich mixture is normally supplied to the engine from the carburetor and it is desirable to have air supplied to the exhaust manifold for mixing with the unburned hydrocarbons and carbon monoxide to permit combustion while they are still hot. This results in a relatively fast heating of converter beds 24 and 26 during cold engine operation. Upon a deceleration during cold engine operation, a vacuum is exerted through nipple 52 to chamber 110 which results in a pressure differential between chamber 110 and closed air chamber 114 thereby to open vent valve 88. Opening of vent valve 88 results in venting chamber 86 to atmosphere through passage 94 and vent 96. Venting chamber 86 to atmosphere results in the movement of main valve 58 to a seated position on seat 56 and the opening of valve 62 thereby to supply air through line 28 to the exhaust pipe 22 downstream of catalytic converter bed 24 and upstream of catalytic converter bed 26. When the pressures are equalized between chamber 110 and closed air chamber 118 through bleed opening 124, vent valve 88 is reseated and chamber 86 is again exposed to a vacuum from vacuum line 42 for opening valve 58 during cold engine operation.

However, in the event the engine has reached a predetermined warm temperature, temperature actuated vacuum switch 46 in line 42 vents line 42 to atmosphere and no vacuum is exerted against chamber 86. Thus, during the entire warm engine operation main valve 58 is seated and air is supplied through line 28 to exhaust pipe 22 as shown in FIG. 2. FIG. 3 shows vent valve 88 unseated with chamber 86 being vented to atmosphere. Vent valve 88 remains unseated from between around two (2) seconds to five (5) seconds depending on the pressure differential between chambers 110 and 114. A vacuum of around twenty (20) inches of mercury is provided when deceleration of the engine occurs from its normal operating condition. When a driver of a vehicle suddenly takes his foot from the accelerator pedal and decelerates the engine, the vacuum in the manifold vacuum chamber 110 increases rapidly to twenty-two (22) to twenty-five (25) inches of mercury, for example. When a driver of a vehicle suddenly accelerates rapidly, the vacuum in the manifold vacuum chamber 108 drops to a relatively low vacuum, for example, less than three (3) inches of mercury which is insufficient to overcome spring 72. When the vehicle is driven at a fast, relatively steady speed, a normal vacuum of twelve (12) to fifteen (15) inches of mercury is provided in manifold vacuum chamber 110 and if the vacuum is gradually increased or decreased, vent valve 88 is not opened as a pressure differential of around four (4) or five (5) inches of mercury is required between chambers 110 and 114 for opening vent valve 88. Thus, under a condition of high deceleration under cold engine operation, air is supplied to exhaust pipe 22 for a predetermined period of time. After the engine has warmed up, air is continuously supplied to the exhaust pipe 22.

It is noted that in the event the air pressure within chamber 76 reaches a predetermined high amount with main valve 58 open as shown in FIG. 1, valve member 62 may unseat against the bias of spring 70 to permit a flow of air to exhaust pipe 22. In addition, when valve member 62 is open and the air pressure in chamber 76 reaches a predetermined high, ball member 152 will unseat until the pressure is relieved. Relief valve 150 minimizes the danger of an over supply of air being provided to the exhaust system which might result in a backfire condition.

While conduit 28 is shown in the drawings as supplying air from nipple 32 to exhaust pipe 22 upstream of the oxidizing catalytic converter bed 26, under some conditions it may be desirable to supply air downstream of catalytic converter bed 26 and if this is desired, line 28A may be connected to exhaust pipe 22 downstream of converter bed 26 as shown in FIG. 1. It is apparent also that if desired, conduit 28 could be connected to atmosphere.

What is claimed is:

1. An air control valve for use on an internal combustion engine having an exhaust system with a catalytic converter bed therein and an air pump for supplying air to the exhaust system, said air control valve comprising:

a valve body having a main air chamber, an air inlet extending to the main air chamber, and a pair of air outlets leading from the main air chamber, one of said air outlets being connected to the exhaust manifold upstream of the catalytic converter bed and the other outlet diverting air away from the catalytic converter bed;

a valve assembly positioned in the main air chamber between the inlet and said pair of outlets for alternating air flow between said pair of outlets, said valve assembly having a main valve member and a secondary valve member mounted thereon, said main valve member controlling air flow through said one outlet and said secondary valve member controlling air flow through said other outlet, said valve assembly being shifted between two positions, one in which the main valve member is open to supply air to said one outlet with the secondary valve member closed and a second position in which the secondary valve member is open to supply air to said other outlet with the main valve member being closed;

a main diaphragm assembly secured to the valve body and connected to the valve assembly, spring biasing means to urge the diaphragm assembly and the valve assembly to said other position in which the main valve member is closed and the secondary valve member is open, said valve body having a main vacuum chamber on one side of the main diaphragm assembly, a vacuum line extending from the intake manifold of the internal combustion engine to the main vacuum chamber, temperature responsive means operatively connected to said vacuum line to permit the exertion of a vacuum against the diaphragm assembly only during cold engine operation, said temperature responsive means being effective to interrupt the vacuum exerted against the diaphragm assembly during warm engine operation to maintain the main valve member in a closed position for diverting air away from the catalytic converter bed during warm engine operation; and vent valve means venting the main vacuum chamber to atmosphere upon a rapid deceleration of the internal combustion engine during both cold engine operation and warm engine operation.

2. An air control valve as set forth in claim 1 wherein a fluid passage extends from the main vacuum chamber to atmosphere;

said vent valve means includes a vent valve in the fluid passage movable between open and closed positions relative to the fluid passage, a stem connected at one end to the vent valve, an auxiliary diaphragm assembly connected to the other end of the stem, and spring biasing means urging the vent valve to a closed position;

said valve body forming an auxiliary vacuum chamber on one side of the auxiliary diaphragm assembly in fluid communication with the intake manifold of said internal combustion engine so that a high deceleration of the combustion engine exerts a high vacuum within the auxiliary vacuum chamber to open the vent valve against the bias of the spring biasing means for venting the main vacuum chamber to atmosphere.

* * * * *